US012692638B2

(12) United States Patent
Joo et al.

(10) Patent No.: US 12,692,638 B2
(45) Date of Patent: Jul. 28, 2026

(54) LAUNDRY TREATMENT DEVICE AND CONTROL METHOD THEREFOR

(71) Applicant: LG ELECTRONICS INC., Seoul (KR)

(72) Inventors: Kook Bae Joo, Seoul (KR); Ka Yeon Kim, Seoul (KR); Hyun Seok Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 169 days.

(21) Appl. No.: 18/696,631

(22) PCT Filed: Sep. 27, 2022

(86) PCT No.: PCT/KR2022/014412
§ 371 (c)(1),
(2) Date: Mar. 28, 2024

(87) PCT Pub. No.: WO2023/055015
PCT Pub. Date: Apr. 6, 2023

(65) Prior Publication Data

US 2024/0392487 A1 Nov. 28, 2024

(30) Foreign Application Priority Data

Sep. 28, 2021 (KR) ..... 10-2021-0127894

(51) Int. Cl.
*D06F 33/36* (2020.01)
*D06F 33/38* (2020.01)
(Continued)

(52) U.S. Cl.
CPC ..... *D06F 33/36* (2020.02); *D06F 33/38* (2020.02); *D06F 34/22* (2020.02); *D06F 34/32* (2020.02);
(Continued)

(58) Field of Classification Search
CPC ... D06F 34/22; D06F 2103/20; D06F 2103/22
See application file for complete search history.

(56) References Cited

U.S. PATENT DOCUMENTS 5,129,241 A * 7/1992 Kiuchi ..... D06F 34/22 68/12.02
5,140,842 A * 8/1992 Kiuchi ..... D06F 34/22 68/12.02
(Continued)

FOREIGN PATENT DOCUMENTS

CN 111926526 A 11/2020
DE 102007034662 A1 * 1/2009 ..... D06F 33/37
(Continued)

OTHER PUBLICATIONS

WO2016135792A1 Machine Translation (Year: 2016).*
(Continued)

*Primary Examiner* — Spencer E. Bell
(74) *Attorney, Agent, or Firm* — Fish & Richardson P.C.

(57) ABSTRACT

A method of controlling a laundry treatment device includes introducing washing water into a tub of the laundry treatment device, identifying first turbidity information on the washing water after the washing water is introduced into the tub, identifying a type of detergent based on the identified first turbidity information, and controlling a washing stroke according to the type of the detergent.

12 Claims, 10 Drawing Sheets

(51) Int. Cl.

| | |
|---|---|
| ***D06F 34/22*** | (2020.01) |
| ***D06F 34/32*** | (2020.01) |
| ***D06F 101/20*** | (2020.01) |
| ***D06F 105/56*** | (2020.01) |
| *D06F 103/22* | (2020.01) |

(52) U.S. Cl.
CPC ..... *D06F 2101/20* (2020.02); *D06F 2103/22* (2020.02); *D06F 2105/56* (2020.02)

(56) References Cited

U.S. PATENT DOCUMENTS

| | | | | |
|---|---|---|---|---|
| 2018/0073177 | A1* | 3/2018 | Zattin | D06F 39/022 |
| 2018/0171529 | A1 | 6/2018 | Xu et al. | |
| 2021/0062397 | A1 | 3/2021 | Cha et al. | |
| 2021/0189627 | A1 | 6/2021 | Cha et al. | |

FOREIGN PATENT DOCUMENTS

| | | | | |
|---|---|---|---|---|
| EP | 3875665 | A1 | 9/2021 | |
| KR | 10-1995-0018824 | | 7/1995 | |
| KR | 10-1995-0032846 | | 12/1995 | |
| KR | 10-2009-0120575 | | 11/2009 | |
| KR | 10-2013-0106241 | | 9/2013 | |
| KR | 10-2017-0135230 | | 12/2017 | |
| KR | 10-2019-0107624 | | 9/2019 | |
| KR | 10-2021-0079062 | A | 6/2021 | |
| WO | WO-2016135792 | A1 * | 9/2016 | D06F 34/22 |

OTHER PUBLICATIONS

DE102007034662A1 Machine Translation (Year: 2009).*
International Search Report and Written Opinion in International Appln. No. PCT/KR2022/014412, mailed on Dec. 14, 2022, 9 pages (with partial English translation).
Extended European Search Report in European Appln. No. 22876787.7, mailed on Jul. 15, 2025, 8 pages.

* cited by examiner

LAUNDRY TREATMENT DEVICE AND CONTROL METHOD THEREFOR

CROSS-REFERENCE TO RELATED APPLICATIONS

This application is a National Stage application under 35 U.S.C. § 371 of International Application No. PCT/KR2022/014412, filed on Sep. 27, 2022, which claims the benefit of Korean Patent Application No. 10-2021-0127894, filed on Sep. 28, 2021. The disclosures of the prior applications are incorporated by reference in their entirety

TECHNICAL FIELD

The present disclosure relates to a laundry treatment device and a control method therefor. More specifically, the present disclosure relates to a laundry treatment device that identifies a type of detergent and correspondingly adjusts a washing stroke according to the identified type of the detergent and a control method therefor.

BACKGROUND ART

A laundry treatment device performs a function of supplying water and detergent when laundry to wash is introduced thereto and washing out a contaminant in the laundry by using motion of a dynamic component inside the laundry treatment device.

In order to perform clean washing, an amount of the laundry and an operation of the laundry treatment device may be determined to be suitable for a type of the detergent. For example, when the type of the detergent is power detergent, the powder detergent may adhere or stick to the laundry, which may cause dermatitis to a user. Thus, a number of washing strokes may be increased. However, most laundry treatment devices may perform washing of the laundry according to an inappropriate way of the washing without identifying the amount of the laundry and the type of the detergent.

In order to overcome the above-described limitations, a solution for further accurately sensing, even when a user directly selects and introduces the detergent, the type of the detergent and an amount of the detergent and accordingly adjusting the operation of the laundry treatment device is required to be provided.

In this regard, US2018/0171529A may be referenced as similar prior documentation. However, the prior documentation only discloses a technical feature of acquiring a detergent concentration through a flow sensor or a liquid sensor and accordingly adjusting a washing stroke and does not disclose a method of varying the washing stroke depending on the type of the detergent.

Meanwhile, since the above-described related art is technical information that an inventor has owned in order to draw the present disclosure or acquired in a process of drawing the present disclosure, the above-described related art may not be necessarily referred to as prior art known publicly before filing of the present disclosure.

DETAILED DESCRIPTION OF THE INVENTION

Technical Goals

Example embodiments of the present disclosure are to provide a laundry treatment device that identifies a type of a detergent and adaptively performs a washing stroke according to the identified type of the detergent and provide a control method therefor.

In addition, example embodiments of the present disclosure are to provide a control method for determining a type of detergent based on a value measured with a turbidity sensor for measuring turbidity of washing water and a laundry treatment device using a same.

Technical Solutions

According to an aspect, there is provided a laundry treatment device including a tub into which laundry is introduced, a water supply unit that supplies washing water to the tub, a sensor unit that senses turbidity of the washing water which is introduced into the tub, and a processor that controls the laundry treatment device according to a type of detergent identified based on first turbidity information on the washing water measured through the sensor unit after the washing water is introduced into the tub.

The processor may be configured to control a washing stroke according to the type of the detergent identified based on the first turbidity information on the washing water, which is measured in at least a portion of a first time period after the washing water is introduced into the tub, and the first turbidity information may be at least one of turbidity value and a variation in the turbidity value.

The processor may be configured to control the laundry treatment device to perform a clothing wetting operation of rotating the tub at a first speed after the first time period and perform a washing operation of rotating the tub at a second speed faster than the first speed.

The tub may not be rotated or may be rotated at a speed slower than the first speed in the first time period. A length of the first time period may be set variously depending on an introduced amount of the detergent.

The laundry treatment device may further include an output unit that provides information on the identified type of the detergent to a user.

The processor may be configured to determine a number of washing strokes depending on an amount of the laundry and a washing mode set by a user, and increase the number of washing strokes when the identified type of the detergent is power detergent.

The processor may be configured to determine, when the identified type of the detergent is liquid detergent, whether to perform additional water supply or additional detergent introduction based on second turbidity information on the washing water, which is measured through the sensor unit in at least a portion of a washing stroke after the first turbidity information is measured, and a rotation speed of the tub at a time of measuring the second turbidity information may be faster than a rotation speed of the tub at a time of measuring the first turbidity information.

The processor may be configured to adjust, when the identified type of the detergent is liquid detergent, a length of a time period during which a washing stroke is performed based on second turbidity information on the washing water, which is measured through the sensor unit in at least a portion of the washing stroke after the first time period.

The type of the detergent may be determined based on an artificial neural network that receives an input on at least one of the turbidity value and the variation in the turbidity value and outputs the type of the detergent.

Effects of the Invention

A laundry treatment device according to example embodiments may determine a type of detergent and adaptively perform a washing stroke according to the determined type of the detergent. Through this, it is possible to improve a washing effect by performing optimal washing suitable for the type of the detergent.

The laundry treatment device according to example embodiments may determine the type of the detergent based on a value measured with a turbidity sensor. Through this, the type of the detergent may be determined without adding an additional sensor, and cost efficiency is increased.

The laundry treatment device according to example embodiments may identify the type of the detergent by analyzing a first time period from a time point of adding the detergent to washing water. Through this, it is possible to flexibly set a washing mode and determine a washing method corresponding to the type of the detergent. Accordingly, it is possible to improve washing performance.

In addition, the laundry treatment device according to example embodiments may measure a contamination level of laundry in real time and the type of the detergent with an operation of an artificial intelligence unit and adaptively change the washing stroke. Through this, it is possible to improve the washing performance.

MODE FOR CARRYING OUT THE INVENTION

Figure 1:
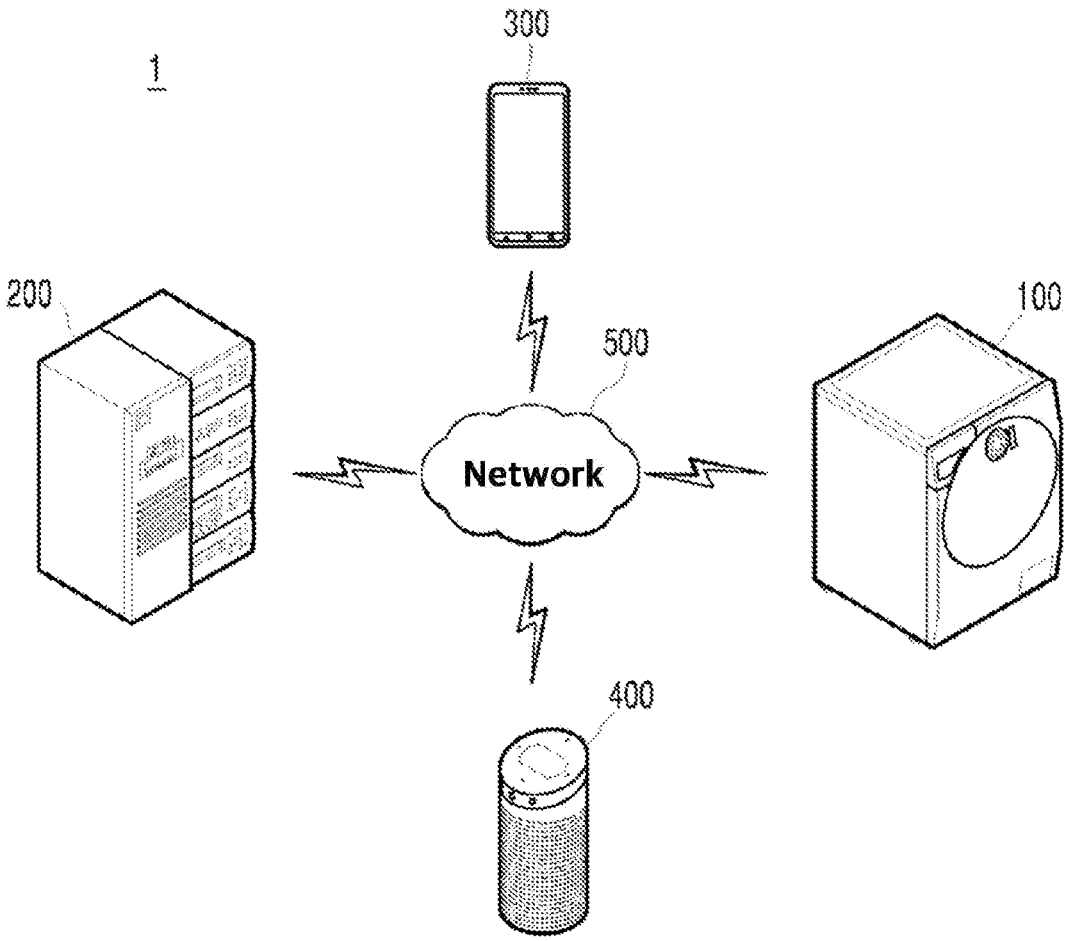
FIG. 1 is an example diagram illustrating a system environment in which a washing machine, a user terminal, an artificial intelligence speaker, and an external server are connected to each other according to an example embodiment of the present disclosure.

Hereinafter, example embodiments of the present disclosure will be described with reference to the drawings.

In describing the example embodiments, descriptions of technical contents that are well known in the art to which the present disclosure belongs and are not directly related to the present specification will be omitted. This is to more clearly communicate without obscuring the subject matter of the present specification by omitting unnecessary descriptions.

For the same reason, in the accompanying drawings, some components are exaggerated, omitted or schematically illustrated. In addition, the size of each component does not fully reflect the actual size. The same or corresponding components in each drawing are given the same reference numerals.

Advantages and features of the present disclosure and methods of achieving them will be apparent from the following example embodiments that will be described in more detail with reference to the accompanying drawings. It should be noted, however, that the present disclosure is not limited to the following example embodiments, and may be implemented in various forms. Accordingly, the example embodiments are provided only to disclose the present disclosure and let those skilled in the art know the category of the present disclosure. The present disclosure is merely defined by a category of the claims. The same reference numerals or the same reference designators denote the same elements throughout the specification.

At this point, it will be understood that each block of the flowchart illustrations and combinations of flowchart illustrations may be performed by computer program instructions. Since these computer program instructions may be mounted on a processor of a general purpose computer, special purpose computer, or other programmable data processing equipment, those instructions executed through the computer or the processor of other programmable data processing equipment may create a means to perform the functions be described in flowchart block(s). These computer program instructions may be stored in a computer usable or computer readable memory that can be directed to a computer or other programmable data processing equipment to implement functionality in a particular manner. Thus, it is also possible for the instructions stored in the computer usable or computer readable memory to produce an article of manufacture containing instruction means for performing the functions described in the flowchart block(s). The Computer program instructions may also be mounted on a computer or other programmable data processing equipment, such that a series of operating steps may be performed on the computer or other programmable data processing equipment to create a computer-implemented process. Accordingly, the instructions for performing the processing equipment may also provide steps for performing the functions described in the flowchart block(s).

In addition, each block may represent a portion of a module, segment, or code that includes one or more executable instructions for executing a specified logical function(s). It should also be noted that in some alternative implementations, the functions noted in the blocks may occur out of order. For example, the two blocks shown in succession may in fact be executed substantially in parallel, or the blocks may sometimes be executed in the reverse order, depending on the corresponding function.

At this point, a term "part (or unit)" in the example embodiments performs a certain role and refers to a software component or a hardware component such as a field-programmable gate array (FPGA) or an application-specific integrated circuit (ASIC). However, a part is not limited to software or hardware. The part may be in a storage medium that may perform addressing, or operate one or more processors. Thus, for example, the part includes components such as software components, object-oriented software components, class components, and task components, processes, functions, attributes, procedures, subroutines, segments of program code, drivers, firmware, microcode, circuits, data, databases, data structures, tables, arrays, and variables. Functions provided in the components and the parts may be combined in the fewer components and the fewer parts or separated in the additional components and the additional parts. In addition, the components and the parts may be realized to operate a device or one or more central processing units (CPU) in a security multimedia card.

FIG. 1 is an example diagram illustrating a system environment in which a washing machine, a user terminal, an artificial intelligence speaker, and an external server are connected to each other according to an example embodiment of the present disclosure.

Referring to FIG. 1, a washing machine 100 may operate in a driving environment including a user terminal 300, an external server 200, an artificial intelligence speaker 400, and a network 500 connecting each other.

The washing machine 100 may include a communication unit, an input unit, a sensing unit including a detergent sensing sensor unit, an output unit including a display, a storage unit including a memory, a power supply unit, a washing unit including physical devices required for washing such as a washing tub, a controller including a washing machine microcontroller unit (MCU), or the like.

The controller of the washing machine 100 may include all types of devices for processing data such as a processor, for example, an MCU. At this point, the processor, for example, may be a data processing device in hardware, which has a physically structured circuit for performing a function presented by code or an instruction included in a program.

An example of such a data processing device built in hardware may include a processing device such as a microprocessor, a central processing unit (CPU), a processor core, a multiprocessor, an application-specific integrated circuit (ASIC), or a field programmable gate array (FPGA). However, scope of the present invention is not limited thereto.

The communication unit of the washing machine 100 may transmit a value received by the detergent sensing sensor unit or a variety of information associated with an operation of the washing machine 100 to the external server 200. The external server 200 may transmit information on washing detergent and a variety of washing information to the washing machine 100, the user terminal 300, and the artificial intelligence speaker 400.

The communication unit of the washing machine 100 may be interlocked with the network 500 and provide a communication interface required for providing a signal transmitted and received between the artificial intelligence speaker 400, the user terminal 300, and/or the external server 200 in a form of packet data.

In addition, the communication part of the washing machine 100 may support a variety of object intelligence communication (e.g., Internet of Things (IoT), Internet of Everything (IoE), Internet of Small Things (IoST), or the like) and also support machine-to-machine (M2M) communication, vehicle-to-everything (V2X) communication, device-to-device (D2D) communication, or the like.

The washing machine 100 may extract detergent information by using big data, an artificial intelligence (AI) algorithm, and/or a machine learning algorithm in a fifth generation (5G) communication environment connected for the IoT and determine an optimal washing operation method.

The artificial intelligence speaker 400 may recognize a voice instruction from a user and send the voice instruction to one of the washing machine 100, the external server 200, and the user terminal 300. Also, the artificial intelligence speaker 400 may receive information from one of the washing machine 100, the external server 200, and the user terminal 300 and send the information to the user in a voice.

The artificial intelligence speaker 400 is illustrated as an example in FIG. 1. However, in an actual use environment, another voice recognition communication device such as an artificial intelligence television (TV) or an artificial refrigerator other than the artificial intelligence speaker 400 may be used. The user may send an instruction in a voice or receive a response in a voice through such devices.

In an example embodiment of the present disclosure, the user terminal 300 may be a desktop computer, a smartphone, a notebook computer, a tablet personal computer (PC), a smart TV, a mobile phone, a personal digital assistant (PDA), a laptop, a media player, a microserver, a global positioning system device, an electronic book terminal, a digital broadcasting terminal, a navigation system, a kiosk, an MP3 player, a digital camera, a home appliance, and another mobile or non-mobile computing device, but is not limited thereto.

In addition, the user terminal 300 may be a wearable terminal such as a watch, glasses, a hair band, and a ring that include a communication function and a data processing function. The user terminal 300 is not limited to the above description, and a terminal for web browsing may be adopted without a limitation.

Meanwhile, the user terminal 300 exemplified as a smartphone and the artificial speaker 400 are separately illustrated in FIG. 1, but generally, a user terminal may include an artificial intelligence speaker that interacts with the user.

The external server 200 may be a database server providing data for operating the washing machine 100 and big data required for applying various artificial algorithms. In addition, the external server 200 may include a web server and an application server for remotely controlling the operation of the washing machine 100 by using a washing machine driving application or a washing machine driving web browser installed in the user terminal 300.

Meanwhile, an artificial neural network may be provided to the external server 200, but such an artificial neural network may be autonomously provided to the washing machine 100.

Figure 2:
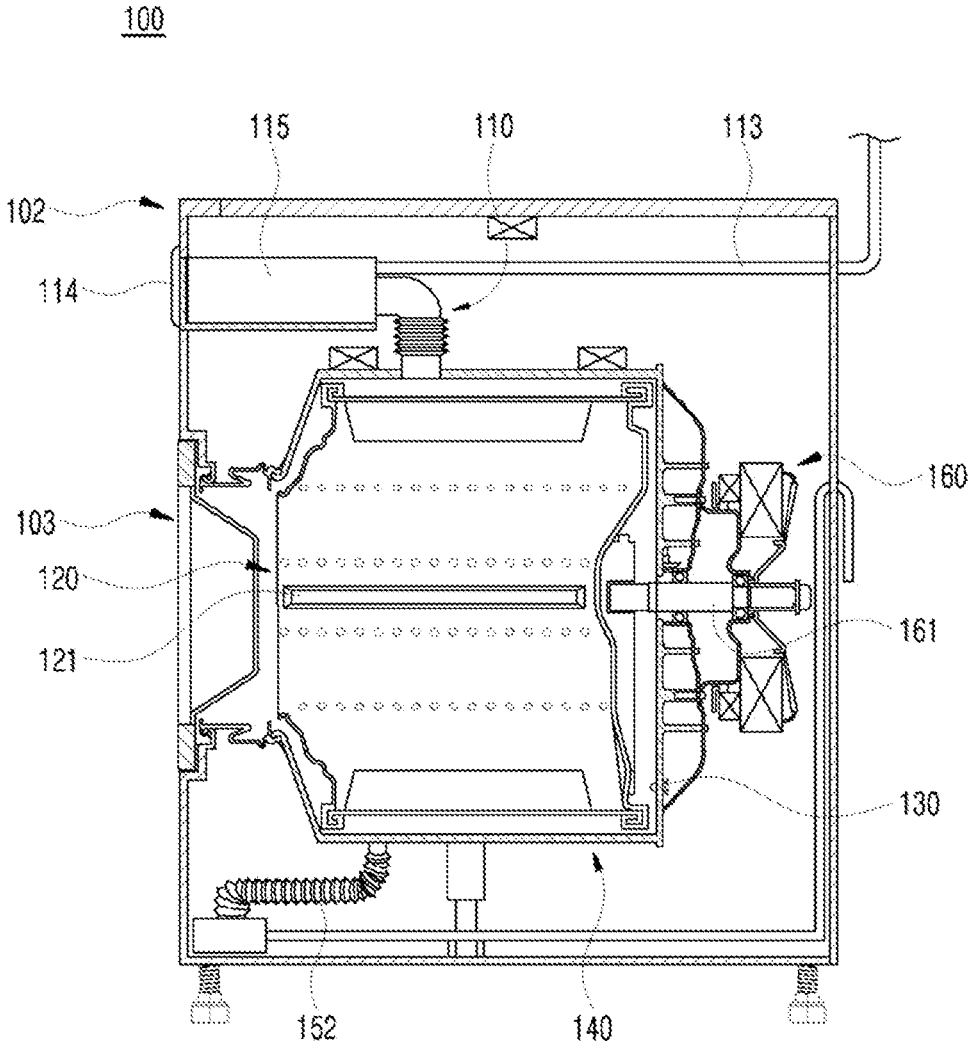
FIG. 2 illustrates a cross-sectional view of a washing machine that adjusts an operation depending on introduced detergent according to an example embodiment of the present disclosure.

FIG. 2 illustrates a cross-sectional view of a washing machine that adjusts an operation depending on introduced detergent according to an example embodiment of the present disclosure.

Referring to FIG. 2, the washing machine 100 may include a cabinet 102, a water supply unit 110 that supplies washing water for washing, a first tub 120 that is positioned inside the cabinet 102 and into which laundry is introduced, a detergent sensing sensor unit 130 for sensing a physical characteristic of the washing water, a second tub 140 receiving the first tub 120, and a motor 160 rotating the first tub 120. Meanwhile, overall example embodiments are described with the washing machine 100 as a reference, but are not limited thereto. Also, it is apparent that an example embodiment of the present disclosure may be applied to overall laundry treatment devices.

The cabinet 102 may form an exterior of the washing machine with a front part, a side surface part, an upper surface part, and a lower surface part. A door 103 that opens and closes an introduction port to the first tub 120 may be formed at the front surface part.

Also, a control panel 114 may be positioned at an upper end of a front surface of the cabinet 102. Multiple buttons for controlling an operation of the washing machine 100 may be provided to the control panel 114. The control panel 114 may include a display for displaying an operation state of the washing machine 100.

The water supply unit 110 may include a water supply pipe 113 and a detergent drawer 115. The detergent drawer 115 may be provided at a side of the control panel 114. A part in which detergent is stored and a part exposed forward of the detergent drawer 115 may be integrally formed. The part exposed forward may be a handle, and thus, a user may open and close the detergent drawer 115.

Water supplied through the water supply pipe 113 may be mixed with the detergent while passing through the detergent drawer 115 and become the washing water. The washing water may pass through the second tub 140 and be supplied to the first tub 120. The washing water used to perform washing in the first tub 120 and rinsing water used to perform rinsing may be discharged outside the washing machine 100 through a drainage pipe 152.

The first tub 120 may be coupled to the second tub 140 in a rotatable manner. An opening part may be provided on a surface of the first tub 120. Thus, liquid supplied into the second tub 140 may flow into the first tub 120, and liquid in the first tub 120 may flow out to the second tub 140.

Here, with a drum washing machine being exemplified, the first tub 120 may be a drum, and the second tub 140 may an external tub receiving the drum. In other example embodiment, the first tub 120 may be referred to as an inner tub, and the second tub 140 may be referred to as an outer tub.

A plurality of lifters 121 installed so that the laundry is caught to be rotated with the first tub 120 may be installed inside the first tub 120. The laundry may be caught by a lifter 121 and rotated with the drum illustrated by reference numeral 120.

The motor 160 may be coupled to the first tub 120 by a rotating shaft 161 and rotate the first tub 120 with motor rotation.

In addition, although not illustrated by FIG. 2, a weight sensor for sensing an amount of the introduced laundry may be positioned in the washing machine 100. The weight sensor may be positioned so as to sense a weight of the first tub 120 for sense a change in the weight of the first tub 120 in order to sense the amount of the introduced laundry.

Meanwhile, the weight sensor may use a method of determining the weight of the laundry introduced into the first tub 120 according to a time taken until the motor 160 rotating the first tub 120 reaches normal revolutions per minute (RPM) after a driving signal is input to the motor 160.

Figure 3:
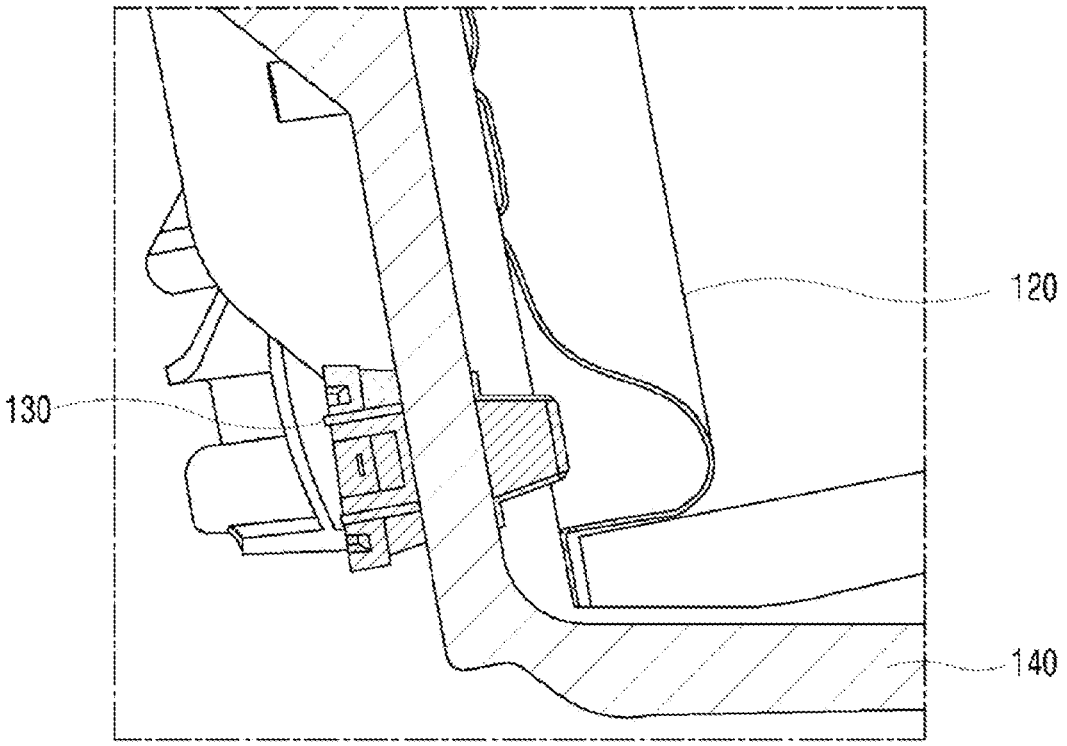
FIG. 3 is a diagram illustrating a coupling relationship between a detergent sensing sensor unit and a washing machine outer tub positioned inside a washing machine according to an example embodiment of the present disclosure.

FIG. 3 is a diagram illustrating a coupling relationship between a detergent sensing sensor unit and a washing machine outer tub positioned inside a washing machine according to an example embodiment of the present disclosure.

Referring to FIG. 3, the washing machine 100 may generally start washing by introducing laundry and washing water into a drum. The washing machine 100 may include a moving inner tub into which the laundry is introduced, an outer tub surrounding the first tub 120 and an inner tub, and the second tub 140. At this point, the first tub 120 may be coupled to the second tub 140 in a rotatable manner, and an opening part functioning as a water passing hole may be formed on a surface of the first tub 120. Water supplied into the first tub 120 may flow out to the second tub 140 through multiple water passing holes formed in the first tub 120.

The washing machine 100 according to an example embodiment of the present disclosure, which controls an operation based on introduced detergent, may include the detergent sensing sensor unit 130 which is coupled to the second tub 140. The detergent sensing sensor unit 130 may be provided to a position at which the water is touched.

In an example embodiment, the detergent sensing sensor unit 130 may be positioned near a bottom of the second tub 120 from which the water is drained after staying for a longest time. In addition, the detergent sensing sensor unit 130 may further safely operates by being coupled to the second tub 140 which is fixed, other than the first tub 120 which is rotated. The detergent sensing sensor unit 130 may be provided as a detachable structure to the second tub 140, and accordingly, component replacement may be easily performed.

The detergent sensing sensor unit 130 may penetrate the second tub 140, touch the washing water in the second tub 140, and sense a physical characteristic of the washing water, for example, electric conductivity, turbidity, a temperature, or like of the washing water.

Since the first tub 120 and the second tub 140 are connected for fluid communication so that liquid in the first tub 120 may flow out to the second tub 140, and since the detergent sensing sensor unit 130 may be coupled to the second tub 140 and sense a physical characteristic of liquid in the second tub 140, the detergent sensing sensor unit 130 may sense physical characteristics of the washing water and rinsing water or a state of the rinsing water. More specifically, the detergent sensing sensor unit 130 may sense turbidity of the washing water and the rinsing water.

A sensing unit of the washing machine 100 may include sensors for sensing element required for determining an operation of the washing machine 100. Unless otherwise described in the present disclosure, the sensing unit may be the detergent sensing sensor unit 130 that senses the physical characteristics of the washing water or the rinsing water.

The detergent sensing sensor unit 130 may transmit, to a washing machine processor through a sensor MCU 132, an initial value of the detergent sensing sensor unit 130, which is measured when a water supply stroke, a drainage stroke, and a dehydration stroke are performed without the detergent and the laundry for examining whether the washing machine 100 operates or not and an installation state thereof when the washing machine 100 is installed in a user home, and a value sensed in final rinsing when a user performs a washing stroke and a rinsing stroke. The washing machine processor may store the initial value of the detergent sensing sensor unit 130 and a detergent sensing sensor value in the final rinsing in a storage unit as reference values.

In an example embodiment of the present disclosure, the washing machine 100 may include the washing machine processor which receives a digital signal from the detergent sensing sensor 130 and determines a contamination level of a washing machine tub. The processor may control overall washing machine operations including the washing stroke, the rinsing stroke, and the dehydration stroke of the washing machine 100.

The processor may determine a type of the detergent which is introduced into the washing water and an amount of the detergent based on the electric conductivity, the turbidity, and the temperature of the washing water and determine an operation method of the washing machine 100 based on the determined type of the detergent and the amount of the detergent.

Further specific configuration of the detergent sensing sensor unit 130 will be described in detail in the following FIG. 4.

Figure 4:
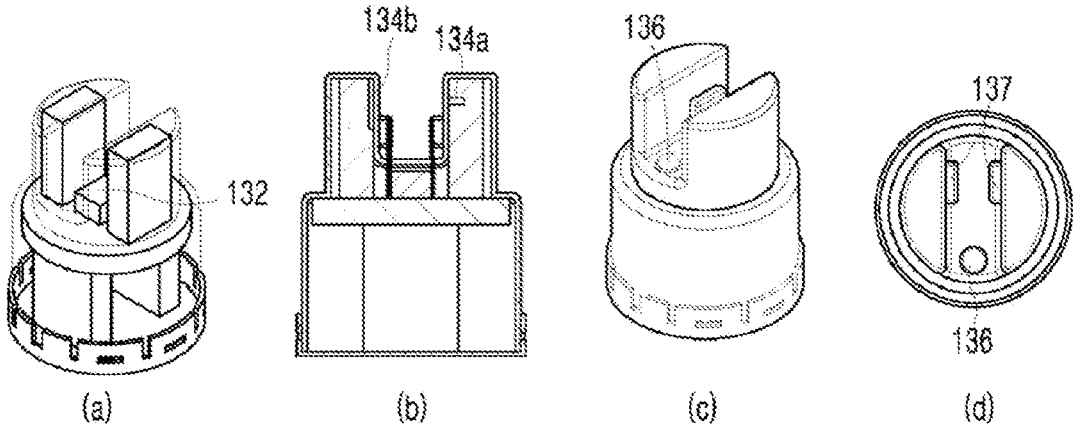
FIG. 4 is a diagram illustrating a detergent sensing sensor unit positioned inside a washing machine according to an example embodiment of the present disclosure.

FIG. 4 is a diagram illustrating a detergent sensing sensor unit positioned inside a washing machine according to an example embodiment of the present disclosure.

Referring to FIG. 4, (a) the sensor MCU 130, (b) a photo sensor 134, (c) a temperature sensor 136, and (d) an electric conductivity sensor 137 of the detergent sensing sensor unit 130 are described. In example embodiments, the detergent sensing sensor unit 130 may include at least one of such elements.

The detergent sensing sensor unit 130 may include the photo sensor 134 for sensing light transmittance in order to sense turbidity of washing water, the temperature sensor 136 for sensing a temperature of the washing water, the electric conductivity sensor unit 137 for sensing electric conductivity of the washing water, and the sensor MCU 132 including a correction algorithm for correcting an electric conductivity value and a transmittance value according to the temperature.

The detergent sensing sensor unit 130 may be a unit including and integrating, into one module, all of the sensors for sensing the electric conductivity, the turbidity, and the temperature and the sensor MCU 132 which corrects a signal sensed by the sensors and changes the signal into a digital signal.

The detergent sensing sensor unit 130 may autonomously include the sensor MCU 132. An analog signal sensed by the sensors may be converted into the digital signal through the sensor MCU 132. The digital signal other than the analog signal may be transmitted to a processor of the washing machine 100. Accordingly, signal disturbance that may occur while the analog signal is transmitted from a sensor may be prevented.

The photo sensor 134 includes a light emitting diode (LED) 134*a* and a phototransistor 134*b* for sensing light emitted from the LED 134*a*. The light emitted from the LED 134*a* of the photo sensor 134 may pass through the washing water in a state in which the second tub 140 is filled with the washing water and may be sent to the phototransistor 134*b*. The turbidity of the washing water may be determined according to a light signal received by the phototransistor 134*b*.

Since the photo sensor 134 senses a degree of light penetration, a concept opposite to the light transmittance may be indicated as the turbidity. When the light transmittance is high in liquid, the turbidity is decreased. In contrast, when the light transmittance is low, the turbidity is increased.

The turbidity of the washing water may vary depending on a floating matter content in the washing water. In addition, the turbidity may be increased when another component other than water is included. As an example, in a case of powder detergent, the turbidity of the washing water may be increased when the powder detergent is not dissolved. Also, in a case of liquid detergent, the washing water may have turbidity higher than that of water, and the turbidity may be increased by occurrence of foam or the like due to introduction of the detergent. Thus, an amount and a type of detergent contained in the washing water may be estimated with the turbidity which is measured through the photo sensor 134. However, since solubility of the detergent may vary depending on a temperature of liquid even if an identical amount of floating matters is present, a turbidity value may be changed depending thereon. Thus, in order to accurately estimate the type and the amount of the detergent, all of the measured turbidity and the temperature of the washing water may be taken into consideration.

The electric conductivity sensor 137 may apply a voltage to two electrodes, sense an intensity of a flowing electric current, and measure the electric conductivity of the washing water. The electric conductivity sensor 137 may be referred to as an electrode sensor. Since the electric conductivity is affected by presence of an ion and a total concentration of ions in water, the electric conductivity may show an amount of substances dissolved in the washing water.

Therefore, the amount or the type of the detergent which is dissolved in the washing water may be estimated according to the electric conductivity of the washing water. However, since an electric conductivity of a solution may be affected by a temperature of the solution in addition to a dissolved substance, the measured electric conductivity may be required to be corrected with the temperature for accurate estimation.

The temperature sensor 136 is for measuring a temperature of liquid. Information on the temperature of the washing water may be used for controlling a washing stroke as well as correcting the electric conductivity and the turbidity value in order to further accurately estimate the amount of the detergent and the type of the detergent as described above.

The detergent sensing sensor unit 130 may correct the turbidity measured by the photo sensor 134 and the electric conductivity measured by the electric conductivity 137 according to a temperature value measured by the temperature sensor 136 as described above.

In other words, the detergent sensing sensor unit 130 may send, other than the measured temperature value and a measured electric conductivity value themselves, a turbidity value and an electric conductivity value to be estimated in a case of a reference temperature to the washing machine processor. Accordingly, the washing machine processor may further accurately estimate the amount of the detergent and the type of the detergent without being affected by the temperature.

Also, the sensor MCU 132 included in the detergent sensing sensor unit 130 may include an analog-to-digital converter (ADC) port. The sensor MCU 132 may receive a signal measured by the photo sensor 134, the temperature sensor 136, and the electric conductivity sensor 137 and convert the signal into a digital signal.

When the washing machine processor sends data, and when an electric conductivity value, a transmittance value, and a temperature are sent in an analog signal, there may be a possibility that the signal which is disturbed due to a noise around a product is sent. Accordingly, a sensitivity error and a temperature correction error may occur.

In contrast, the detergent sensing sensor unit 130 according to example embodiments of the present disclosure may include and integrate the electric conductivity sensor 137, the photo sensor 134, the temperature sensor 136, and the sensor MCU 132 into the one module. Accordingly, the detergent sensing sensor unit 130 may be provided so as to convert the analog signal which is measured by the sensors into the digital signal, perform correction with the temperature for the electric conductivity value and the transmittance value required for detergent sensing, and then output a digital value corrected with the temperature.

Thus, the detergent sensing sensor unit 130 may transmit a detergent sensing sensor unit value that is digital data corrected with the temperature to the washing machine processor. Through this, when compared to an analog signal being sent from existing sensors to a washing machine controller, the sensitivity error and the temperature correction error may be reduced, and accuracy of a sensed value may be increased.

Figure 5:
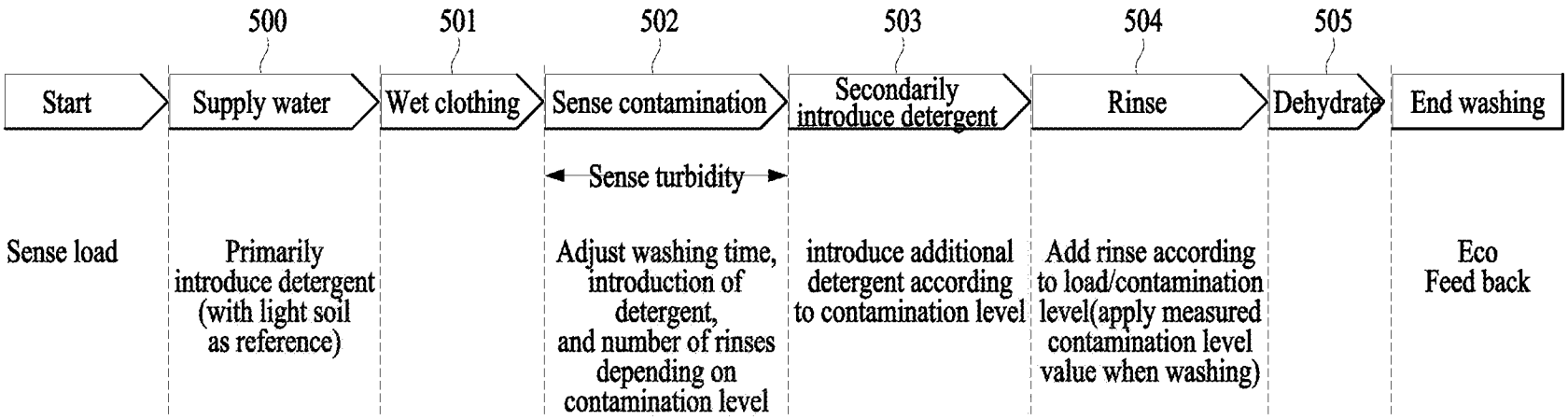
FIG. 5 is a diagram illustrating overall operations of a laundry treatment device according to example embodiments.

FIG. 5 is a diagram illustrating overall operations of a laundry treatment device according to example embodiments.

Specifically, FIG. 5 is a diagram illustrating, by operation, the laundry treatment device introducing washing water into a tub, supplying the washing water to the tub through a water supply unit, sensing turbidity of the washing water which is introduced into the tub through a sensor unit, controlling the laundry treatment device according to a type of detergent identified based on turbidity information on the washing water, which is measured through the sensor unit, and controlling a washing stroke according to the type of the detergent identified based on first turbidity information on the washing water, which is measured in at least a portion of a first time period after the washing water is introduced into the tub. A portion of each operation may be selectively performed in overall example embodiments.

Referring to FIG. 5, the laundry treatment device may perform at least one of water supply operation 500 of supplying the washing water to the tub, clothing wetting operation 501 of performing clothing wetting in the tub having the washing water, contamination sensing operation 502 of sensing a contamination degree of the clothing, secondary detergent introduction operation 503 of introducing the detergent for the washing stroke, rinsing operation 504 of performing the washing stroke by using the introduced detergent, and dehydration operation 505 of dehydrating the clothing.

In water supply operation 500, the laundry treatment device supplies the washing water to the tub. The laundry treatment device according to example embodiments may wet laundry in the washing water or control the washing water and the laundry to be mixed with each other by introducing and rotating the laundry at a predetermined speed. Meanwhile, in example embodiments, primary detergent introduction may be performed in water supply operation 500. In addition, an operation of identifying the type of the detergent which is introduced in the water supply operation 500 may be performed together as described below. As an example, after water supply is performed, the turbidity may be measured before the tub is rotated, and the type and an amount of the detergent may be sensed based on a tendency of a change in a turbidity value according to dissolution of the detergent after the detergent is introduced into the washing water. Meanwhile, in example embodiments, in an operation of determining the turbidity in order to identify the type of the detergent, the tub may not be rotated or may be rotated at a speed slower than a rotation speed in a subsequent operation. Through this, a turbidity change after introduction of the detergent into the washing water may be easily measured.

In clothing wetting operation 501, the laundry treatment device according to example embodiments may introduce the laundry into the washing water and rotate the tub at a first speed. For example, the laundry treatment device may rotate the tub at the first speed so that a portion of contaminants sticking to or included in the laundry and the washing water may be mixed. Here, the first speed may be set so that centrifugal force acting on the laundry according to example embodiments is determined to be less than or equal to a predetermined value. For example, the laundry treatment device according to example embodiments may measure a weight of the laundry, calculate, based on the measured weight, the first speed to rotate the tub at so that the centrifugal force acting on the laundry is less than or equal to the predetermined value, and rotate the tub at the calculated first speed. Meanwhile, the weight of the laundry may be performed before water supply operation 500.

Also, for example, the laundry treatment device according to example embodiments may introduce the washing water into the laundry so that a contaminant of the laundry and the washing water may be mixed, and may stop the tub for a predetermined time in the clothing wetting operation 501.

In contaminant sensing operation 502, the laundry treatment device may measure, by using a photo sensor (or a turbidity sensor included in the photo sensor), a contamination level of the washing water mixed with the contaminant in clothing wetting operation 501. For example, when the turbidity of the washing water mixed with the contaminant is high, the laundry treatment device may determine a contamination level of the laundry to be high.

The laundry treatment device may determine a washing stroke (or a washing mode) based on the contamination level measured in contaminant sensing operation 502. For example, when the contamination level is high, the laundry treatment device according to example embodiments may operate so as to perform a washing stroke having a highest intensity of washing. As an example, the laundry treatment device may adaptively determine a washing time for the laundry, an initial amount to introduce the detergent, a number of rinses for the laundry, and a rotation speed of the tub having the laundry (e.g., a second speed) based on the contamination level which is sensed.

In secondary detergent introduction operation 503, when the contamination level is determined to be high or additional detergent introduction is determined to be required based on a change in the contaminant and an extent of the contaminants during performance of a washing operation according to the washing stroke which is set in contaminant sensing operation 502, the laundry treatment device may introduce additional detergent.

In rinsing operation 504, the laundry treatment device may rotate the tub so that the laundry, the washing water, and the detergent are mixed to separate the contaminant from the laundry. More specifically, the tub may be rotated according to a predetermined pattern, and the laundry therein may perform an action of predetermined motion according to rotation of such a predetermined pattern.

In dehydration operation 505, the laundry treatment device may perform an operation for dehydrating the laundry which is wet after the rinsing operation 504 is ended. Drainage may be performed before dehydration operation 505 or during performance of dehydration operation 505.

As described above, the laundry treatment device according to example embodiments may perform clothing wetting operation 501 and determine a degree to which the laundry is contaminated in contamination sensing operation 502 before washing the laundry and may provide an effective laundry washing effect by flexibly adjusting and changing the washing mode based on a result of a determined contamination degree. For example, the laundry treatment device may sense the contamination level, perform adjusting the washing time, a detergent introduction degree, the number of times of the rinsing, or the like, and determine whether to secondarily introduce the detergent, an amount to secondarily introduce the detergent, whether to add more rinses, or the like.

However, when the washing mode is determined simply based on a degree of contamination, there may be a possibility of selecting an unsuitable washing stroke depending on the type of the detergent, and the laundry may be washed with a method unsuitable for the type of the detergent. For example, when the type of the detergent is powder detergent, since a grain of the powder detergent may stick or adhere to the laundry unlike a case in which the type of the detergent is liquid detergent, a washing temperature may be required to be variously adjusted, and a rinsing method may be also required to be variously performed.

Therefore, the laundry treatment device according to example embodiments is required to identify the type of the detergent before performing clothing wetting operation 501. Thus, before performing clothing wetting operation 501, the laundry treatment device is required to sense, by using the turbidity sensor, the turbidity and a variation in the turbidity over a flow of a time (e.g., a first time period) from a time point at which the detergent is supplied to the washing water to a predetermined time point and identify the type of the detergent.

Hereinafter, a time period in which the laundry treatment device according to example embodiments performs a process of identifying the type of the detergent by using the turbidity sensor before performing clothing wetting operation 501 may be referred to as the first time period. The first time period, for example, may include a time from a time point at which washing the laundry is started or a time point at which a portion of the detergent is supplied to the washing water to a predetermined time point (e.g., a time point at which a change in the turbidity of the washing water becomes insignificant, that is, the variation is less than or equal to a predetermined value or the like).

Hereinafter, a method of the laundry treatment device identifying the type of the detergent by using the turbidity sensor during the first time period.

Figure 6:
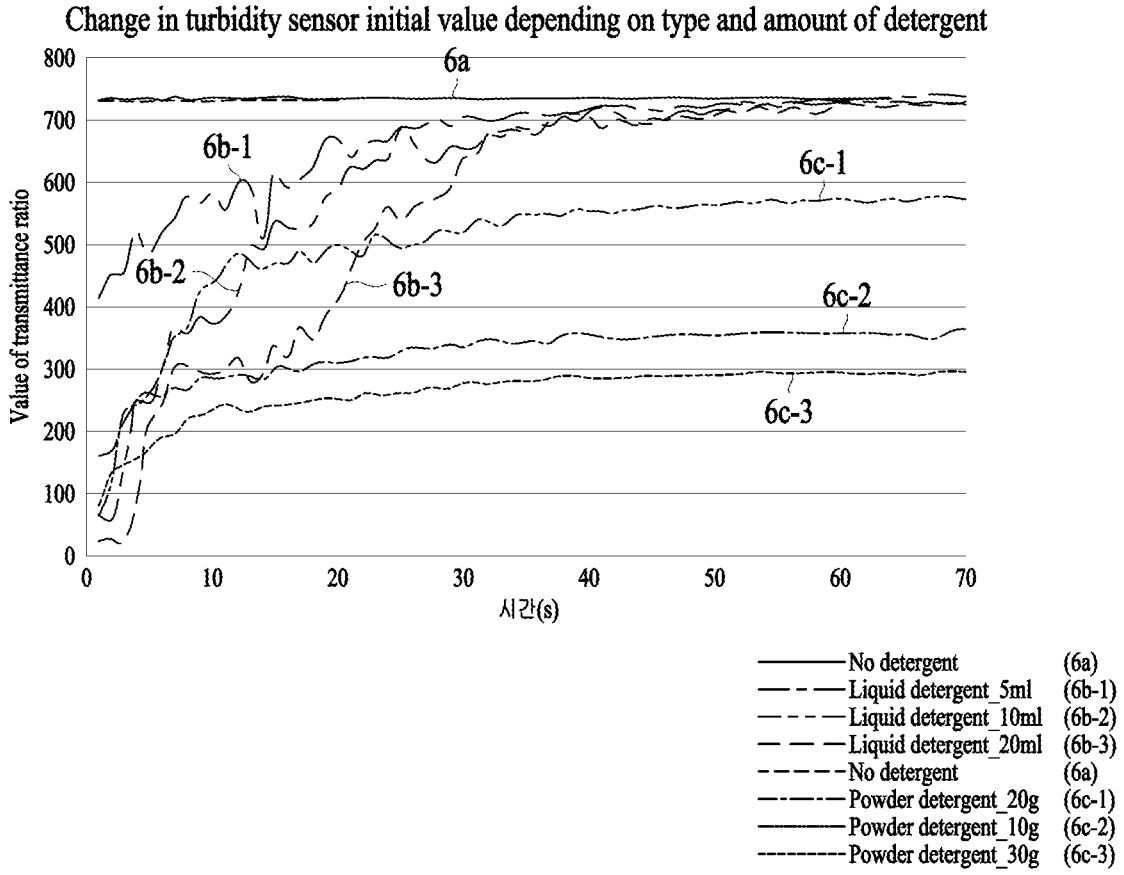
FIG. 6 is a diagram illustrating a method of a laundry treatment device estimating an amount and a type of detergent by using a detergent sensing sensor unit according to example embodiments.

FIG. 6 is a diagram illustrating a method of a laundry treatment device estimating an amount and a type of detergent by using a detergent sensing sensor unit according to example embodiments.

Referring to FIG. 6, a change in a value of a transmittance ratio measured by a turbidity sensor is illustrated when detergent of each type is introduced into washing water in a corresponding volume.

The laundry treatment device according to example embodiments may introduce the washing water into a tub as described above and introduce the detergent into the washing water introduced into the tub before performing clothing wetting. In addition, the laundry treatment device may introduce the detergent together with washing water in example embodiments.

The laundry treatment device may measure a turbidity value of the washing water into which the detergent is introduced and a variation in the turbidity value through the turbidity sensor according to example embodiments and identify the type and amount of the detergent based thereon.

FIG. 6 illustrates changes in the value of the transmittance ratio (e.g., a vertical axis) of the washing water as a time (e.g., a horizontal axis) lapses according to a case in which the detergent is not introduced into the washing water (e.g., "no detergent"), cases in which liquid detergent is introduced in each volume, and cases in which powder detergent is introduced in each volume. The value of the transmittance ratio (e.g., the vertical axis) which is measured in FIG. 6, for example, may be a light amount measured by a photo sensor according to example embodiments. The value of the transmittance ratio, which is illustrated in FIG. 6, being high may be a case in which the washing water is transparent and thus, a large amount of penetrating and sensed light is present. In contrast, The value of the transmittance ratio being low may be a case in which the washing water is opaque and thus, a small amount of the penetrating and sensed light is present. That is, when the value of the transmittance ratio is high, turbidity may be low, and when the value of the transmittance ratio is low, the turbidity may be high. In example embodiments, when the liquid detergent is introduced, and when a predetermined time elapses, the transmittance ratio may be increased up to a range similar to that of "no detergent". However, for the powder detergent, there is a difference by detergent, but the turbidity value may not be increased to a predetermined level or more. As such, when the liquid detergent is introduced, a degree of a change in the transmittance ratio may be shown to be greater than that in a case in which the powder detergent is introduced. As such, a time period taken for the value of the transmittance value to converge may be referred to as a first time period. In such a first time period, the introduced detergent may be sensed by measuring the change in the transmittance ratio. Also, the type of the introduced detergent may be determined by identifying the change in the transmittance ratio while the tub is not rotated or is rotated at a low speed after the detergent is introduced.

In example embodiments, the changes in the value of the transmittance ratio (or a change in the turbidity value) over a flow of a time in a case in which the introduced detergent is absent as illustrated by reference numeral 6*a*, in cases in which the introduced detergent is detergent in a form of liquid as illustrated by reference numerals 6*b*-1 through 6*b*-3, and in cases in which the introduced detergent is the powder detergent as illustrated by reference numerals 6*c*-1 through 6*c*-3 is illustrated.

In example embodiments, when the introduce detergent is absent as illustrated by the reference numeral 6*a*, the value of the transmittance ratio is maintained to be a value of a transmittance ratio of the washing water itself, and a change in the turbidity is also insignificant.

In example embodiments, when the detergent is introduced into the washing water, the transmittance ratio is decreased at an initial stage as the detergent is introduced. For example, referring to the reference numeral 6*b*-1, the value of the transmittance ratio may be identified as being decreased to 400 at a time point at which the liquid detergent is introduced and identified as converging to a predetermined value (e.g., a convergence value) as the value of the transmittance ratio is gradually increased while the liquid detergent is mixed with the washing water. For the powder detergent, referring to the reference numeral 6*c*-1, the value of the transmittance ratio may be identified as being decreased to 100, being gradually increased, and converging to a predetermined value (e.g., a convergence value). In other words, the turbidity value may be also identified as being increased at a time point of detergent introduction and as converging to a predetermined value (e.g., a convergence value).

In example embodiments, for the liquid detergent of the reference numerals 6*b*-1 through 6*b*-3, a difference between the convergence value of the value of the transmittance ratio and the value of the transmittance ratio of the washing water may be insignificant. On the other hand, for the powder detergent of the reference numerals 6*c*-1 through 6*c*-3, a difference between the convergence value of the value of the transmittance ratio and the value of the transmittance ratio of the washing water may be large. Thus, the laundry treatment device according to example embodiments may identify whether the type of the detergent is the liquid detergent or the powder detergent based on the value of the transmittance ratio (or the turbidity value) which converges after the detergent is introduced into the washing water.

In example embodiments, when the detergent is introduced in a large amount (for example, as illustrated by the reference numeral 6*b*-3 or 6*c*-3), the value of the transmittance ratio which is measured at an initial stage may be low because an amount of detergent agglomeration is large (that is, the turbidity value may be high). On the other hand, when the detergent is introduce in a small amount (for example, as illustrated by the reference numeral 6*b*-1 or 6*c*-1), the value of the transmittance ratio measured at the initial stage may be high because the amount of the detergent agglomeration is small (that is, the turbidity value may be low). Thus, the laundry treatment device according to example embodiments may identify the amount of the detergent based on a lowest value of values of the transmittance ratio which is decreased after the detergent is introduced into the washing water or the like.

In example embodiments, the type of the detergent may be variously identified depending on a time taken until the detergent is completely dissolved in the washing water (that is, until the turbidity value converges) from the time point of the detergent introduction. For example, the liquid detergent is dissolved in the washing water at a speed higher than that of the powder detergent, and accordingly, the value of the transmittance ratio (or the turbidity value) after the detergent introduction quickly converges to the convergence value. In contrast, the powder detergent is dissolved in the washing water at a low speed, and accordingly, the value of the transmittance ratio (or the turbidity value) after the detergent introduction slowly converges to the convergence value. Thus, the laundry treatment device according to example embodiments may measure a variation in the transmittance ratio (or the variation in the turbidity value) within a predetermined time after the detergent introduction and identify the type of the detergent.

In example embodiments, when the type of the detergent is the liquid detergent, since a frequency of foam occurrence is high at a time of the detergent introduction, the change in the value of the transmittance ratio (or the turbidity value) may be measured with high flexibility. On the other hand, when the type of the detergent is the powder detergent, since the frequency of the foam occurrence is low at a time of the detergent introduction, the change in the value of the transmittance ratio (or the turbidity value) may be measured with low flexibility. Thus, the laundry treatment device according to example embodiments may analyze flexibility of the value of the transmittance ratio (or the turbidity value) from the time point of the detergent introduction and identify the type of the detergent. In other words, when the value of the transmittance ratio (or the turbidity value) is flexibly changed, the type of the detergent may be identified as the liquid detergent. On the other hand, when the turbidity value is not flexibly changed, the type of the detergent may be identified as the powder detergent.

Meanwhile, in example embodiments, the laundry treatment device may identify the type of the detergent based on the value of the transmittance ratio after a predetermined time elapses after the detergent is introduced. In example embodiments, for the liquid detergent, the value of the transmittance ratio is close to 700 after forty seconds elapses. For the powder detergent, although varying depending on an introduced amount, the value of the transmittance ratio is not increased above 600. Thus, a detergent value may be identified based on the value of the transmittance ratio which is measured after forty seconds elapses after the detergent is introduced. In example embodiments, such a time value may vary depending on an experiment environment. However, for the liquid detergent, the value of the transmittance ratio may be similar to that of "no detergent" when a predetermined time elapses. For the powder detergent, the value of the transmittance ratio may vary depending on the introduced amount. However, since the transmittance ratio is not increased above a predetermined value, the type of the introduced detergent may be identified based thereon.

In addition, in example embodiments, the laundry treatment device may identify the type of the detergent based on change information on the value of the transmittance ratio, which corresponds to a predetermined time period after the detergent introduction. More specifically, when twenty seconds elapses after the powder detergent is introduce, the value of the transmittance ratio is not greatly changed. In contrast, the value of the transmittance ratio is changed even in twenty through thirty seconds after introduction of the liquid detergent. Based on such a difference, the laundry treatment device may identify the type of the introduced detergent.

Also, in example embodiments, when 5 milliliters (ml) of the liquid detergent is introduced, an initial value of the transmittance ratio may be higher when compared to a case in which the detergent is introduced in another volume or type. Thus, in a predetermined case, the laundry treatment device may identify a volume or the type of the introduced detergent based on the initial value of the transmittance ratio after the detergent introduction.

The laundry treatment device according to example embodiments may flexibly set a washing mode depending on the type of the detergent by analyzing the first time period from a time point at which the detergent is added to the washing water and identifying the type of the detergent, and may improve washing performance by determining a washing method corresponding to the type of the detergent.

Figure 7:
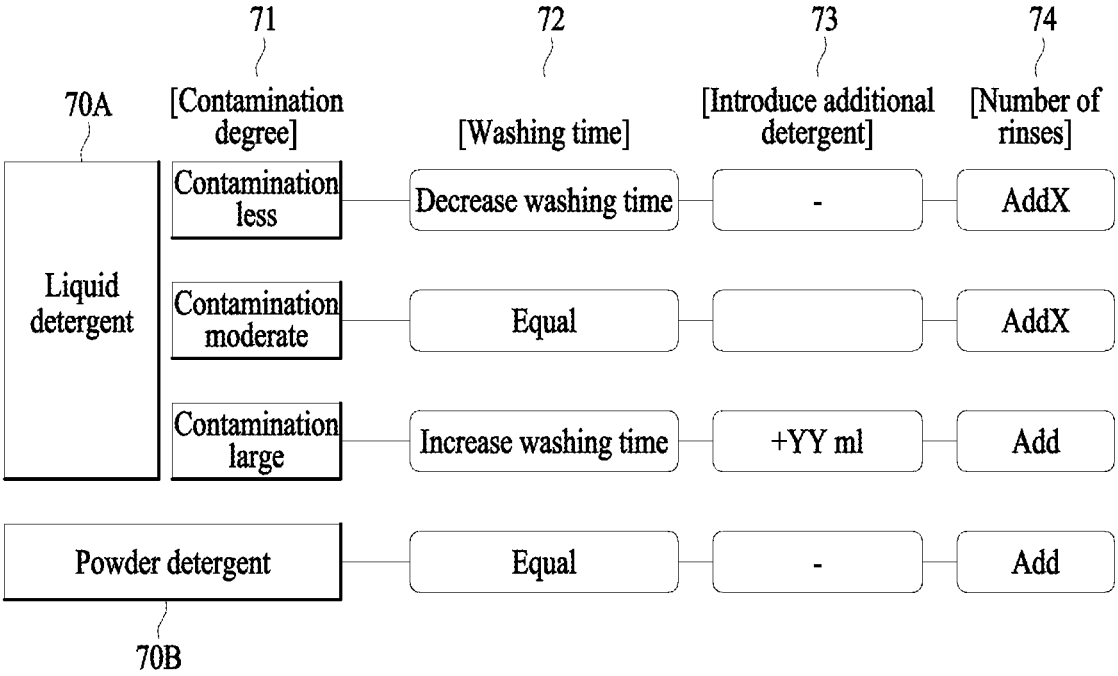
FIG. 7 illustrates a process of a laundry treatment device determining or identifying a washing stroke according to example embodiments.

FIG. 7 illustrates a process of a laundry treatment device determining or identifying a washing stroke according to example embodiments.

Referring to FIG. 7, a portion or all of operations illustrated in example embodiments may be performed in the laundry treatment device according to example embodiments. FIG. 7 illustrates overall operations of the laundry treatment device according to example embodiments, and specifically, FIG. 7 illustrates operations of selecting and determining the washing stroke depending on a type of detergent (e.g., reference numerals 70A and 70B) and a contamination degree (e.g., a contamination level) 71 in a case of liquid detergent.

The laundry treatment device according to example embodiments may variously perform the washing stroke depending on the type of the detergent (e.g., the reference numerals 70A and 70B).

For example, when the detergent is powder detergent 70B, the laundry treatment device may perform a washing stroke of a first mode corresponding thereto. In the washing stroke of the first mode, for example, laundry may be washed according to a washing time 72 and an additional detergent introduction degree 73 set by a user or a system. A number of rinses 74 may be set to a number of rinses increased further than a number of rinses set by the user or the system.

For example, when the detergent is liquid detergent 70A, the laundry treatment device may perform a washing stroke of a second mode corresponding thereto. The laundry treatment device according to example embodiments may identify the contamination degree 71 of the laundry according to the washing stroke of the second mode. A method of the laundry treatment device identifying the contamination degree 71 may be performed based on methods described in FIGS. 5 and 6 (e.g., contamination sensing operation 502 in FIG. 5).

The laundry treatment device according to example embodiments may identify the contamination degree 71 and classify contamination levels according to a plurality of classes (or groups). For example, the laundry treatment device may classify the contamination degree 71 of the laundry as "contamination high (or contamination large)", "contamination moderate", or "contaminated low (or contamination less)". For example, in order to identify the contamination degree 71, the laundry treatment device according to example embodiments may identify turbidity of washing water (for example, such as in contamination sensing operation 502 of FIG. 5) and classify the contamination degree 71 based on a turbidity value of the washing water.

When the contamination degree 71 of the laundry is high as a result of the laundry treatment device according to example embodiments identifying the contamination degree 71, the washing time 72 set by the user or the system may be increased, the additional detergent introduction degree 73 set by the user or the system may be increased, and the number of rinses 74 may be also increased. In addition, when the contamination degree 71 of the laundry is low as a result of the laundry treatment device according to example embodiments identifying the contamination degree 71, the washing time 72 set by the user or the system may be decreased, the additional detergent introduction degree 73 set by the user or the system may be decreased, and the number of rinses 74 may be also decreased. Furthermore, when the contamination degree 71 of the laundry is moderate as a result of the laundry treatment device according to example embodiments identifying the contamination degree 71, the laundry may be washed according to the washing time 72 and the additional detergent introduction degree 73, and the number of rinses 74 which are set by the user or the system.

Figure 8:
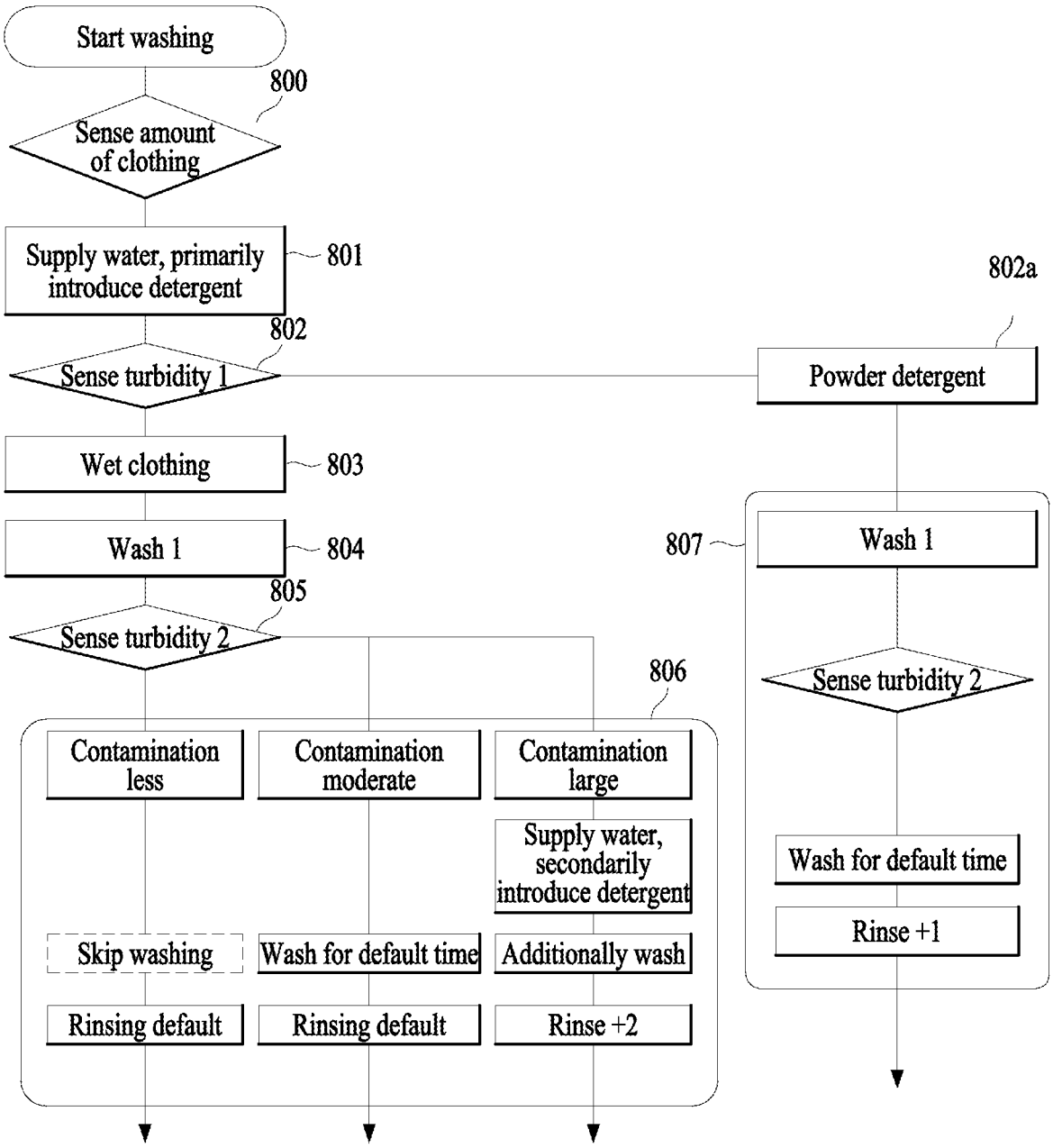
FIG. 8 is a diagram illustrating an example of overall operations of a laundry treatment device according to example embodiments.

FIG. 8 is a diagram illustrating an example of overall operations of a laundry treatment device according to example embodiments.

A portion or all of the operations illustrated in FIG. 8 may be performed in the laundry treatment device according to example embodiments illustrated in FIGS. 1 through 7.

Referring to FIG. 8, a method of the laundry treatment device sensing a type of detergent and variously performing a washing stroke depending on the sensed type of the detergent is illustrated.

To begin with, in operation 800, the laundry treatment device according to example embodiments may sense an amount of laundry in a drum. For example, the laundry treatment device may sense a weight of the laundry in the drum or a size of the laundry by using a sensor unit according to example embodiments. As an example, the amount of the laundry may be measured by measuring force applied to the drum according to rotation of the drum. Meanwhile, in example embodiments, the laundry treatment device may determine at least one of a number of washes, a number of rinses, and an intensity of dehydration based on the sensed amount of the laundry and a washing mode set by a user. In addition, when the sensed type of the detergent is powder detergent, the determined number of washes may be changed, and information on the changed number of washes may be provided to the user through an output unit.

In operation 802, the laundry treatment device according to example embodiments supplies washing water to the drum and primarily introduces the detergent into the washing water. The laundry treatment device may determine an amount to primarily introduce the detergent based on the weight of the laundry in the drum or the size of the laundry which are identified in operation 801.

The laundry treatment device according to example embodiments sensing turbidity of the washing water into which the detergent is primarily introduced in operation 802 and determines the type of the detergent. An operation of example embodiments, for example, may be performed after operation 500 of FIG. 5 and before operation 501 of FIG. 5, and a portion or all of the operations described above in FIG. 6 may be performed.

In operation 803, the laundry treatment device according to example embodiments performs a clothing wetting operation for wetting the laundry in the washing water when the detergent is liquid detergent. A clothing wetting operation of reference numeral 803, for example, may be clothing wetting operation 501 of FIG. 5 and an operation for identifying a contamination degree of the laundry according to example embodiments. Afterwards, in operation 804, the laundry treatment device may perform primary washing of the laundry according to a washing time, an additional detergent introduction degree, and a number of rinses that are determined based on a contamination level identified after the clothing wetting operation is performed. For example, a portion or all of the operations illustrated above in FIG. 7 may be performed in operation 804, and operation 804 may be one washing stroke.

As described above, the laundry treatment device according to example embodiments may determine the contamination degree of the laundry by performing the clothing wetting operation before washing the laundry and provide an effective laundry washing effect by flexibly adjusting and changing the washing mode based on a result of the determined contamination degree.

In operation 805, the laundry treatment device may further sense the turbidity of the washing water in order to further identify the contamination degree of the laundry after performing the primary washing of the laundry. In addition, referring to FIG. 8, in operation 806, the laundry treatment device according to example embodiments may identify the contamination degree based on the sensed turbidity, select a washing stroke according to the contamination degree, and perform the washing stroke. In operation 806, the laundry treatment device according to example embodiments may perform secondary washing of the laundry according to a washing time, an additional detergent introduction degree, and a number of rinses that are determined based on the contamination level which is further identified after the primary washing of operation 804 is performed. For example, a portion or all of the operations illustrated above in FIG. 7 may be performed in operation 806.

In operation 807, when the detergent is the powder detergent as illustrated by reference numeral 802*a*, the laundry treatment device may perform a washing stroke corresponding to the powder detergent. The washing stroke corresponding to the powder detergent, for example, may correspond to operation 806 that is the secondary washing in which washing is variously performed depending on the primary washing and the contamination level or may correspond to a washing stroke performed with one method.

Meanwhile, when the detergent is powder detergent, since a grain of the powder detergent may stick or adhere to the laundry unlike a case in which in which the detergent is the liquid detergent, a rinsing method may be required to be differently set. Thus, in the washing stroke corresponding to the powder detergent, which is performed by the laundry treatment device according to example embodiments, a number of rinses may be set to a number of rinses increased further than a number of rinses set by the user or set by a system. In addition, the increased number of rinses, for example, may be set based on an amount of the powder detergent, which is introduced in a washing process. For example, since an amount of powder that may stick or adhere to the laundry may be large when the amount of the powder detergent is large, the number of rinses may be largely increased. On the other hand, since the amount of the powder that may stick or adhere to the laundry may be small when the amount of the powder detergent is small, the number of rinses may be less increased. Here, the introduced amount of the powder detergent may be determined based on the amount (or the weight, or the size) of the laundry as described above and additionally determined depending on the contamination degree of the laundry. Meanwhile, in operation 807, the laundry treatment device may omit turbidity sensing and perform an operation of adding at least one time to a preset number of rinses after performing washing.

The laundry treatment device according to example embodiments may determine a best washing method corresponding to the type of the detergent (e.g., the liquid detergent, the powder detergent, or the like) with such operations and thus, may increase an effect of washing.

Meanwhile, the laundry treatment device of example embodiments may provide information on the sensed type of the detergent and a change in the washing stroke according thereto to the user through the output unit.

Figure 9:
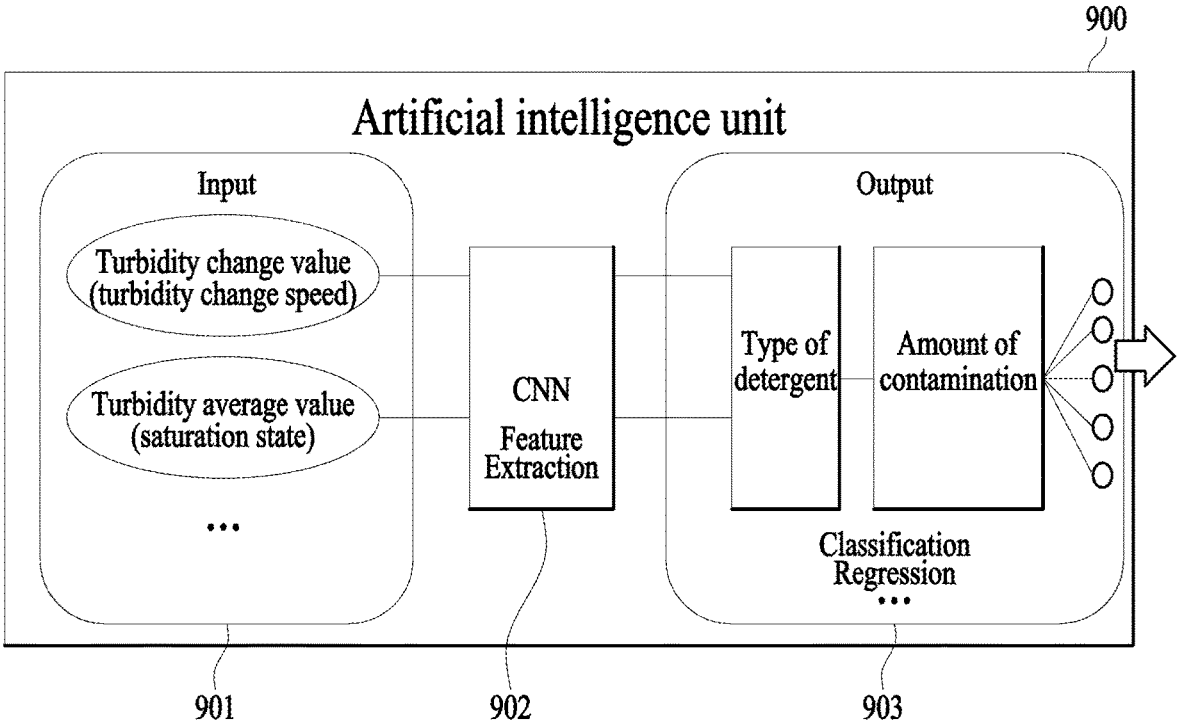
FIG. 9 illustrates an artificial intelligence unit included in a laundry treatment device according to example embodiments.

FIG. 9 illustrates an artificial intelligence unit 900 included in a laundry treatment device according to example embodiments.

Specifically, FIG. 9 illustrates a configuration for performing an operation of identifying a type of detergent, which is described in FIGS. 5 and 6, and the configuration may be included in the laundry treatment device according to example embodiments.

The artificial intelligence unit 900 according to example embodiments determines the type of the detergent by using a turbidity value and a variation in turbidity of washing water during a first time period after the laundry treatment device introduces the detergent into the washing water. The artificial intelligence unit 900 may include a model for receiving an input on information indicating the turbidity value and the variation in the turbidity of the washing water and outputting information indicating the type of the detergent.

The artificial intelligence unit 900 according to example embodiments may include a learning model configured to output the type of the detergent by learning a training set including information indicating a variation in the turbidity value, the turbidity value (e.g., a convergence value of the turbidity value or the like), and the type of the detergent which corresponds thereto. For example, the model included in the artificial intelligence model 900 may include an artificial neural network model 902, an input layer 901 for receiving an input on the information indicating the turbidity value and the variation in the turbidity of the washing water, and an output layer 903 for outputting the information indicating the type of the detergent.

The artificial intelligence unit 900 according to example embodiments, for example, may include one or more hidden layers 902. The one or more hidden layers 902, for example, may be layers configured in a simple linear form or a collection of layers configured as a convolutional neural network (CNN), a recurrent neural network (RNN), and/or a long short-term memory model (LSTM) including a pooling model or a convolution model for feature extraction. In addition, the information indicating the type of the detergent may be information classified based on a classification model for selecting and classifying one of types of detergent.

Also, the artificial intelligence unit 900 according to example embodiments, for example, may identify a contamination degree (e.g., a contamination level) of laundry in contamination sensing operation 502 or secondary detergent introduction operation 503 of FIG. 5. For example, the artificial intelligence unit 900 according to example embodiments may measure the contamination degree of the laundry based on a change in the turbidity value of the washing water in a washing stroke process and determine whether to change a washing stroke based on the measured contamination degree. For example, the artificial intelligence unit 900 may measure the turbidity value of the washing water and the variation in the turbidity value over a flow of a time in real time, measure the contamination level in real time, and change the washing stroke when the contamination level is greater than or equal to a predetermined value.

In this case, the artificial intelligence unit according to example embodiments may include an artificial neural network model including a regression model that receives an input on the turbidity value of the washing water or the like in order to identify the contamination level in real time and outputs the contamination degree.

Since the laundry treatment device according to example embodiments may flexibly determine the washing stroke depending on the type of the detergent by identifying an amount of the detergent and the type of the detergent with an operation of the artificial intelligence unit 900, a washing effect by detergent may be increased, and a washing operation due to a faulty washing method may be prevented.

In addition, the laundry treatment device according to example embodiments may flexibly change the washing stroke by observing and identifying the contamination level of the laundry in real time with the operation of the artificial intelligence unit 900. Through this, the washing effect may be greatly increased.

Figure 10:
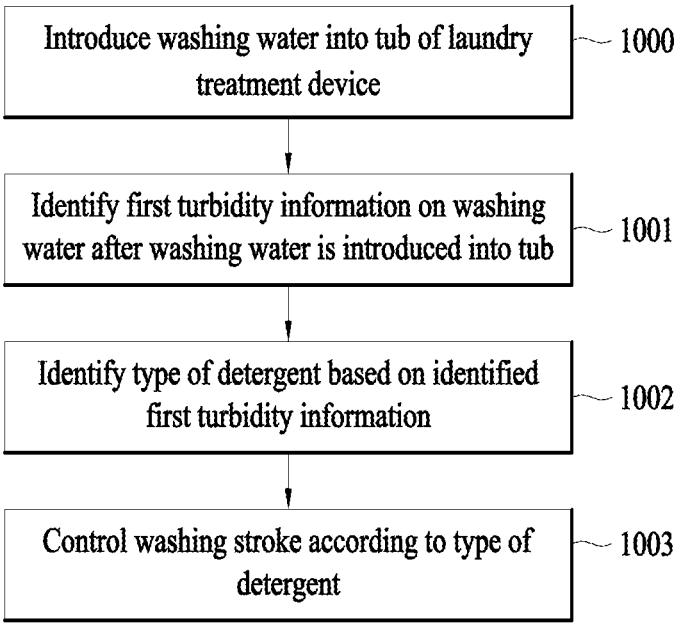
FIG. 10 illustrates an example of a method of controlling a laundry treatment device according to example embodiments.

FIG. 10 illustrates an example of a method of controlling a laundry treatment device according to example embodiments.

Referring to FIG. 10, the method of controlling the laundry treatment device may include at least one of operations 1000 through 1003. A portion or all of operations illustrated in FIG. 10 may be performed by the laundry treatment device according to the above-described example embodiments.

In operation 1000, the laundry treatment device according to example embodiments may introduce washing water into a tub of the laundry treatment device. The laundry treatment device may introduce detergent together with the washing water.

In operation 1001, the laundry treatment device according to example embodiments may identify first turbidity information on the washing water after the washing water is introduced into the tub. The first turbidity information on the washing water according to example embodiments may include at least one of a turbidity value of the washing water and a variation in the turbidity value of the washing water. Meanwhile, in example embodiments, the laundry treatment device may stop rotation of the tub or rotate the tub at a speed lower than a speed in a subsequent stroke in order to identify the first turbidity information.

In operation 1002, the laundry treatment device according to example embodiments may identify a type of the detergent based on the identified first turbidity information. Also, the laundry treatment device may identify at least one of the type of the detergent and an amount of the detergent based on change information on the turbidity value of the washing water, which is measured during a first time period.

In operation 1003, the laundry treatment device according to example embodiments may control a washing stroke based on at least one of the type and the amount of the detergent. An operation of controlling the washing stroke may be performed to correspond to the example embodiments described in FIG. 8.

For example, when the identified type of the detergent is powder detergent, a number of rinsing strokes may be increased. Also, for example, when the identified type of the detergent is liquid detergent, whether to perform additional water supply or additional detergent introduction based on second turbidity information on the washing water, which is measured through a sensor unit in at least a portion of a washing stroke after the first time period, may be determined. Furthermore, when the identified type of the detergent is liquid detergent, a length of a time period during which a washing stroke is performed based on the second turbidity information on the washing water, which is measured through the sensor unit in at least a portion of the washing stroke after the first time period, may be adjusted. Meanwhile, in example embodiments, the second turbidity information may be performed in a middle of the washing stroke, and a rotation speed of the tub in a time period of measuring the second turbidity information may be faster than a rotation speed of the tub in a time period of measuring the first turbidity information.

Meanwhile, in operation 1003 of controlling the washing stroke, the washing stoke may be controlled according to the type of the detergent identified based on the first turbidity information on the washing water, which is measured in at least a portion of the first time period after the washing water is introduced into the tub. In addition, in operation 1003 of the controlling, the laundry treatment device may be controlled to perform a clothing wetting operation of rotating the tub at a first speed after the first time period and perform a washing operation of rotating the tub at a second speed faster than the first speed.

In addition, the tub may not be rotated or may be rotated at a speed slower than the first speed in the first time period according to example embodiments.

As described above, the laundry treatment device according to example embodiments may determine a contamination degree of the laundry by performing the clothing wetting operation before washing the laundry and provide an effective laundry washing effect by flexibly adjusting and changing a washing mode based on a result of the determined contamination degree.

The laundry treatment device according to example embodiments may flexibly set the washing mode depending on the type of the detergent by analyzing the first time period from a time point at which the detergent is added to the washing water and identifying the type of the detergent. The laundry treatment device according to example embodiments also may determine a washing method corresponding to the type of the detergent, and thus, greatly increase a washing effect.

The laundry treatment device according to example embodiments may flexibly determine the washing stroke depending on the type of the detergent by identifying the amount of the detergent and the type of the detergent with an operation of an artificial intelligence unit, and thus, increase a washing effect by detergent and prevent a washing operation due to a faulty washing operation.

In addition, the laundry treatment device according to example embodiments may flexibly change the washing stroke by observing and identifying a contamination level of the laundry in real time with the operation of the artificial intelligence unit. Through this, the laundry treatment device according to example embodiments may greatly increase the washing effect.

Meanwhile, the present specification and drawings have been described with respect to the example embodiments of the present disclosure. Although specific terms are used, it is only used in a general sense to easily explain the technical content of the present disclosure and to help the understanding of the invention, and is not intended to limit the scope of the specification. It will be apparent to those skilled in the art that other modifications based on the technical spirit of the present disclosure may be implemented in addition to the embodiments disclosed herein.

The electronic device or terminal in accordance with the above-described embodiments may include a processor, a memory which stores and executes program data, a permanent storage such as a disk drive, a communication port for communication with an external device, and a user interface device such as a touch panel, a key, and a button. Methods realized by software modules or algorithms may be stored in a computer-readable recording medium as computer-readable codes or program commands which may be executed by the processor. Here, the computer-readable recording medium may be a magnetic storage medium (for example, a read-only memory (ROM), a random-access memory (RAM), a floppy disk, or a hard disk) or an optical reading medium (for example, a CD-ROM or a digital versatile disc (DVD)). The computer-readable recording medium may be dispersed to computer systems connected by a network so that computer-readable codes may be stored and executed in a dispersion manner. The medium may be read by a computer, may be stored in a memory, and may be executed by the processor.

The present embodiments may be represented by functional blocks and various processing steps. These functional blocks may be implemented by various numbers of hardware and/or software configurations that execute specific functions. For example, the present embodiments may adopt integrated circuit configurations such as a memory, a processor, a logic circuit, and a look-up table that may execute various functions by control of one or more microprocessors or other control devices. Similarly to that elements may be executed by software programming or software elements, the present embodiments may be implemented by programming or scripting languages such as C, C++, Java, and assembler including various algorithms implemented by combinations of data structures, processes, routines, or of other programming configurations. Functional aspects may be implemented by algorithms executed by one or more processors. In addition, the present embodiments may adopt the related art for electronic environment setting, signal processing, and/or data processing, for example. The terms "mechanism", "element", "means", and "configuration" may be widely used and are not limited to mechanical and physical components. These terms may include meaning of a series of routines of software in association with a processor, for example.

The above-described embodiments are merely examples and other embodiments may be implemented within the scope of the following claims.

Meanwhile, the present specification and drawings have been described with respect to the example embodiments of the present disclosure. Although specific terms are used, it is only used in a general sense to easily explain the technical content of the present disclosure and to help the understanding of the invention, and is not intended to limit the scope of the specification. It will be apparent to those skilled in the art that other modifications based on the technical spirit of the present disclosure may be implemented in addition to the embodiments disclosed herein.

The invention claimed is:

1. A laundry treatment device comprising:

a tub configured to receive laundry;

a water supply unit configured to supply washing water to the tub;

a sensor unit configured to sense turbidity of the washing water introduced into the tub; and a processor configured to control the laundry treatment device according to a type of detergent that is identified based on first turbidity information on the washing water, wherein the first turbidity information is measured in a first time period, through the sensor unit, after the washing water is introduced into the tub, wherein the processor is configured to control a washing stroke according to the type of the detergent that is identified based on the first turbidity information on the washing water, wherein the first turbidity information includes a variation in turbidity value, wherein the processor is configured to:

based on a first degree of change of the turbidity value within the first time period, identify the type of detergent to be a liquid detergent, and based on a second degree of change of the turbidity value within the first time period, identify the type of detergent to be a powder detergent, and wherein the first degree of change is greater than the second degree of change.

2. The laundry treatment device of claim 1, wherein the processor is configured to control a washing stroke according to the type of the detergent identified based on the first turbidity information on the washing water, the first turbidity information being measured in at least a portion of a first time period after the washing water is introduced into the tub, and wherein the first turbidity information includes turbidity value and the variation in the turbidity value.

3. The laundry treatment device of claim 2, wherein the processor is configured to control the laundry treatment device to perform a clothing wetting operation of rotating the tub at a first speed after the first time period and perform a washing operation of rotating the tub at a second speed faster than the first speed.

4. The laundry treatment device of claim 3, wherein the tub is configured to, in the first time period, not rotate, or rotate at a speed slower than the first speed.

5. The laundry treatment device of claim 2, wherein a length of the first time period is variably set depending on an introduced amount of the detergent.

6. The laundry treatment device of claim 1, further comprising an output unit configured to provide information on the identified type of the detergent to a user.

7. The laundry treatment device of claim 1, wherein the processor is configured to:

determine a number of washing strokes depending on an amount of the laundry and a washing mode set by a user; and increase the number of washing strokes based on the identified type of the detergent being the powder detergent.

8. The laundry treatment device of claim 1, wherein the processor is configured to determine, based on the identified type of the detergent being the liquid detergent, whether to perform additional water supply or additional detergent introduction based on second turbidity information on the washing water, the second turbidity information being measured through the sensor unit in at least a portion of a washing stroke after the first turbidity information is measured.

9. The laundry treatment device of claim 8, wherein a rotation speed of the tub at a time of measuring the second turbidity information is faster than a rotation speed of the tub at a time of measuring the first turbidity information.

10. The laundry treatment device of claim 2, wherein the type of the detergent is determined based on an artificial neural network that receives an input on at least one of the turbidity value or the variation in the turbidity value and outputs the type of the detergent.

11. A method of controlling a laundry treatment device, the method comprising:

introducing washing water into a tub of the laundry treatment device;

identifying first turbidity information on the washing water after the washing water is introduced into the tub;

identifying a type of detergent based on the identified first turbidity information; and controlling a washing stroke according the type of the detergent, wherein the first turbidity information is measured in a first time period after the washing water is introduced into the tub, the first turbidity information including a variation in turbidity value, wherein identifying the type of detergent comprises:

identifying, based on a first degree of change of the turbidity value within the first time period, the type of detergent to be a liquid detergent, and identifying, based on a second degree of change of the turbidity value within the first time period, the type of detergent to be a powder detergent, and wherein the first degree of change is greater than the second degree of change.

12. A computer-readable recording medium configured to store a computer program for executing the method of claim 11 by using a computer.

* * * * *